US006970088B2

(12) United States Patent
Kovach

(10) Patent No.: US 6,970,088 B2
(45) Date of Patent: Nov. 29, 2005

(54) METHOD FOR TRACKING AND PROCESSING PASSENGERS AND THEIR TRANSPORTED ARTICLES

(75) Inventor: Aram Kovach, Lewis Center, OH (US)

(73) Assignee: Compex, Inc., Lewis Center, OH (US)

( * ) Notice: Subject to any disclaimer, the term of this patent is extended or adjusted under 35 U.S.C. 154(b) by 0 days.

(21) Appl. No.: 10/687,792

(22) Filed: Oct. 17, 2003

(65) Prior Publication Data

US 2004/0124982 A1 Jul. 1, 2004

Related U.S. Application Data

(60) Provisional application No. 60/419,185, filed on Oct. 17, 2002.

(51) Int. Cl.[7] ..... G08B 13/14
(52) U.S. Cl. ..... 340/572.1; 340/505; 235/375
(58) Field of Search ..... 340/572.1, 573.1, 340/505; 235/375, 384, 385; 705/5; 707/3

(56) References Cited

U.S. PATENT DOCUMENTS 5,051,565 A * 9/1991 Wolfram ..... 235/384
5,313,052 A * 5/1994 Watanabe et al. ..... 235/375
5,401,944 A * 3/1995 Bravman et al. ..... 235/375
5,793,639 A * 8/1998 Yamazaki ..... 700/226
5,866,888 A * 2/1999 Bravman et al. ..... 235/375
5,920,053 A * 7/1999 DeBrouse ..... 235/375
6,044,353 A * 3/2000 Pugliese, III ..... 705/5
6,085,976 A * 7/2000 Sehr ..... 235/384
6,100,804 A * 8/2000 Brady et al. ..... 340/572.7
6,108,636 A * 8/2000 Yap et al. ..... 705/5
6,111,506 A * 8/2000 Yap et al. ..... 340/572.1
6,112,989 A * 9/2000 Sheldon ..... 235/384
6,119,096 A * 9/2000 Mann et al. ..... 705/5
6,335,688 B1 * 1/2002 Sweatte ..... 340/573.1
6,801,907 B1 * 10/2004 Zagami ..... 707/3

* cited by examiner

*Primary Examiner*—Jeffery Hofsass
*Assistant Examiner*—George Bugg
(74) *Attorney, Agent, or Firm*—Eley Law Firm Co.; James R. Eley; Michael A. Forhan

(57) ABSTRACT

A method for tracking and handling people and articles at an airport using Radio-Frequency Identification ("RFID") tags. The RFID tag contains an electronic microchip with a memory portion, permanently attached to a substrate having a planar antenna. Each RFID tag is tuned to operate at a specific frequency and includes a unique identifier number stored in the memory portion. Passenger-specific information, such as passenger name, address and flight itinerary may be sent to the microchip for storage in the memory portion by means of an RF field provided by an external "scanner" device. The scanner also provides a means for reading data stored in the memory portion of the microchip. The RFID tag is small, rugged, and unobtrusive, allowing it to be applied to passenger articles and documents, allowing for more efficient check-in, automated tracking of articles, theft prevention, and increased security.

4 Claims, 2 Drawing Sheets

METHOD FOR TRACKING AND PROCESSING PASSENGERS AND THEIR TRANSPORTED ARTICLES

This application claims priority to U.S. provisional patent application 60/419,185, filed Oct. 17, 2002, the contents of which are hereby incorporated by reference.

FIELD

This invention relates to a method for tracking and handling people and articles. Specifically, the invention relates to a method for tracking and handling people and articles within an airport environment.

BACKGROUND

Airports face growing challenges with regard to security. Recent terrorist attacks and the increasing sophistication of terrorist tactics have created a need for more thorough screening of passengers, checked baggage, carry-on items, and packages being shipped by air. The added security has caused passenger inconvenience, flight delays, and increased instances of lost baggage and packages.

Aside from security concerns, airports have a desire to facilitate movement of passengers, baggage, and packages as quickly and efficiently as possible. Such areas of movement include passenger ticketing, baggage check-in, security checkpoints, and passenger movement to and between gates in the terminal.

Various methods have been devised for identifying articles such as packages and baggage and associating them with passengers. At the most basic level, tags or labels having passenger-specific information are affixed to the articles and some passenger-associating information, such as an identification number, is hand-keyed into an airline record or computerized tracking database. More sophisticated systems may utilize bar-coded tags and labels. While bar coding reduces the amount of time required to track articles, the tags must still be manually and individually passed under a bar code reader, or a hand-held reader must be passed over the tag in order to read the tag. This can take a significant amount of time and effort when large quantities of articles must be handled, such as baggage and packages for a departing commercial airliner. Delayed flight departures and missed flights frequently occur when the articles are not timely loaded onto the aircraft, generating passenger angst and resulting in increased shipping and handling expenses for packages due to the labor required.

There is a need for a faster, less labor-intensive and more reliable means for tracking articles entering and leaving an airport facility. There is a further need to streamline the tracking process for articles as they migrate through the airport. Yet another need exists to more efficiently associate articles with passengers, and facilitate increased security measures without undue hindrance to passenger movement about the airport terminal.

SUMMARY

The present invention provides a method for tracking and handling people and articles using Radio-Frequency Identification ("RFID") tags. An example RFID tag is the DURA-LABEL® tag manufactured by Single Chip Systems Corporation of San Diego, Calif., although RFID tags and associated systems manufactured by others may likewise be utilized with the present invention. The RFID tag typically contains an electronic microchip, which may be permanently attached to a substrate containing a small planar antenna. Each RFID tag is adapted by the manufacturer to operate at a specific frequency and with a unique identifier number. In addition, the tag may be programmed remotely with information including, but not limited to, passenger name and address, flight itinerary, destination, a baggage record number, contents of the baggage, and emergency contact phone numbers.

The identifier number of the passive microchip on the RFID tag is read by an external Radio Frequency ("RF") field provided by a "scanner" device, which also provides a means for transmitting data to be written to the microchip. A memory portion of the RFID tag facilitates storage of data by static means, eliminating any need for batteries or other "keep-alive" power sources. The microchip is also capable of communicating the RFID tag's identifier number and any data stored on the microchip to a receiver portion of the scanner when interrogated by the scanner. The RFID tag is small, rugged, and unobtrusive, allowing it to be applied to articles by any number of convenient means. For example, the RFID tag may be made part of a passenger's identifying means, such as a credit card or frequent-flyer card. The RFID tag may also be made an integral part of baggage tags, passenger tickets, passports, boarding passes, and other travel documents. Further, the RFID tag may be affixed to packages being shipped by air. For example, the tag may be integrated into the shipping container, the packaging material, shipping documents, labels, and the article or articles being shipped in the package. In one embodiment, an RFID microchip is integrated into an optically coded label, enabling the label to be read by either optical or RF scanning devices.

Use of the RFID tag with passengers, articles, and passenger documents provides airline personnel and security forces with a new tool for facilitating faster check-in, automating tracking of articles, preventing theft, and increasing security.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
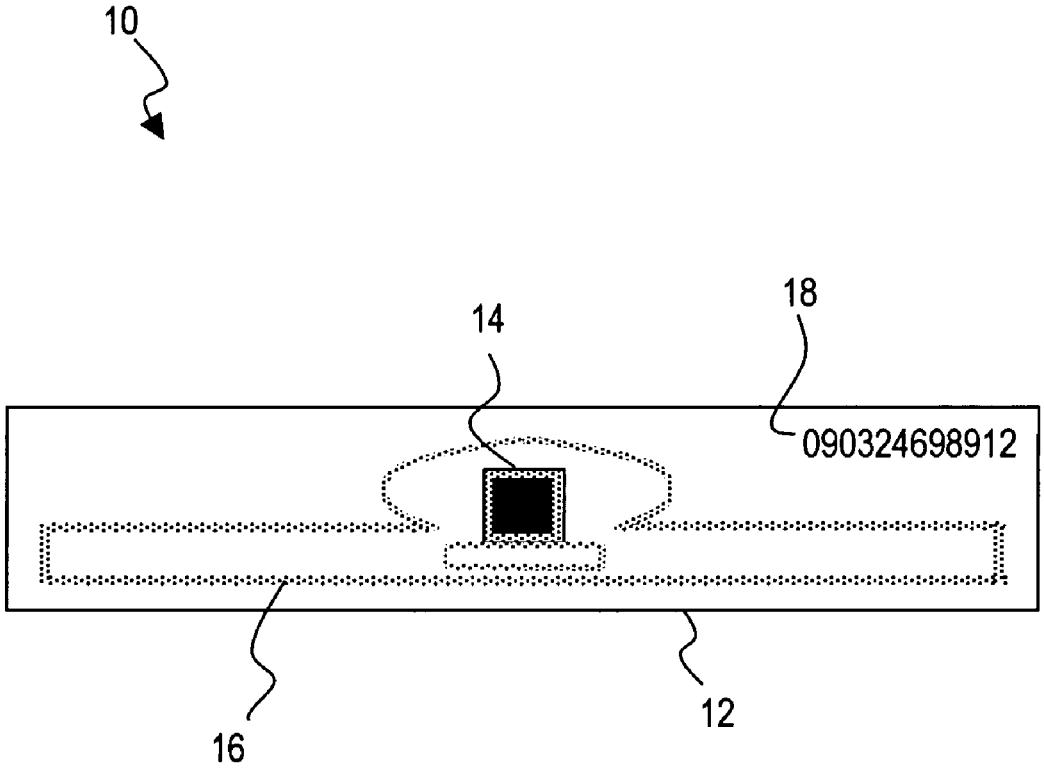
FIG. 1 is a top plan view of an example RFID tag.

The general arrangement of one type of conventional RFID tag 10 usable with the present invention is illustrated in FIG. 1. A passive RFID tag 10 is assembled on a flexible substrate 12, such as a plastic film. A microchip 14, permanently affixed to substrate 12, comprises a memory portion (not shown) adapted to electronically store data. The memory portion preferably comprises a static memory and does not require a continuous source of electrical power in order to retain the data. Microchip 14 further comprises RF-powered transmitter and receiver portions (not shown) to enable storage and retrieval of data from the memory portion by means of Radio Frequency ("RF") energy. A planar antenna 16 is permanently affixed to substrate 12, and is electrically coupled to the transmitter and receiver portions of microchip 14. Each RFID tag 10 may have a unique identifier number 18 to distinguish it from other RFID tags 10. Identifier 18 may also be stored in the memory portion of microchip 14.

In operation, non-memory portions of microchip 14 of RFID tag 10 are selectively powered by an external RF field emitted by an electrical scanner (not shown). The electrical scanner also communicates with RFID tag 10 by modulating the scanner's RF field to transmit data to the memory portion of microchip 14 via a receiver portion of the microchip that is coupled to antenna 16. The scanner may also retrieve data stored in the memory portion of microchip 14 via a transmitter portion of the microchip. An RF signal emitted by a transmitter portion of microchip 14 is modulated in any conventional manner with the data stored in the memory portion. The RF signal of microchip 14 is coupled to antenna 16, where the signal is emitted. The emitted signal is received by a receiver portion (not shown) of the scanner.

It should be noted that the term "scanner" as used herein is intended to comprise an RFID scanning portion having an RF transmitter adapted to communicate with a receiver portion of an RFID tag 10. The information electronically stored on the microchip of the RFID tag is read via an external Radio Frequency ("RF") field provided by a "scanner" device, which also provides a means for transferring data to the microchip. RFID scanners are well-known in the art. An example is the INSTASCAN® RFID Scanner manufactured by Single Chip Systems Corporation of San Diego, Calif. Alternative RFID scanners and associated systems manufactured by others may likewise be satisfactorily utilized with the present invention. For example, scanners maybe adapted to electrically scan passengers to sense RFID tags 10 and/or geostationary position satellite ("GPS") data associated with a cell phone (not shown) carried by a passenger who moves in proximity to the scanner.

The scanner further comprises an RF receiver adapted to communicate with a transmitter portion of RFID tag 10, and an RF emitter adapted to provide a temporary source of electrical power to the RFID tag. In one embodiment of the present invention, the RF emitter and the RF transmitter signals are combined into a single signal. The scanner may additionally comprise a computer portion to control the RFID scanning portion; receive and store data received from the scanning portion; interpret data; and issue commands to external devices in response to an interpretation of the data. The computer portion may be a stand-alone computer, or may be part of an electronic communications network such as an intranet or the internet. In one embodiment of the present invention the scanner may comprise a plurality of scanning portions distributed about the airport and in electrical communication with one or more computers, such as a computer network. One or more scanners may also be used to carry out the present invention, and the scanners may be coupled together to form a network of scanners. It is understood that the term "scanner" used herein refers interchangeably to any of these embodiments.

Figure 2:
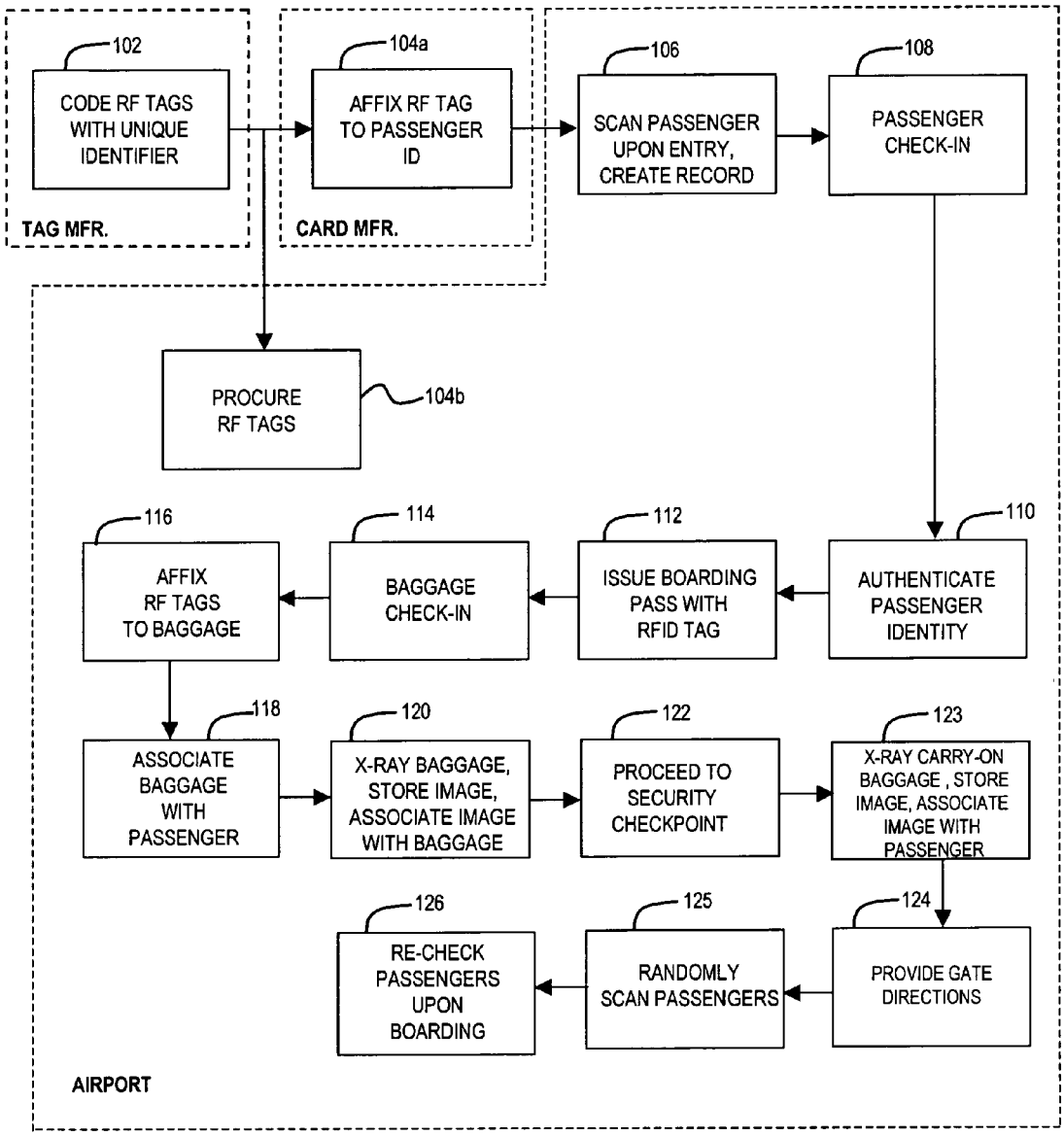
FIG. 2 is a flow diagram of a method for tracking and processing passengers and their articles according to an embodiment of the present invention.

A flow diagram of a method for tracking and processing passengers and their transported articles according to an embodiment of the present invention is shown in FIG. 2, and should be referred to in conjunction with FIG. 1 throughout the following discussion. At step 102 an RFID tag 10 is provided with a unique identifier, such as a numeric or alphanumeric string 18, by the manufacturer of the tag. The identifier 18 may be imprinted onto substrate 12 of RFID tag 10, with the same number being electronically stored in the memory portion of microchip 14.

At step 104*a* the RFID tag 10 is affixed to a means for identifying a specific passenger including, but not limited to, a credit card, passport, "frequent flyer" card, government-issued identification card, and driver's license. The RFID tag 10 may be affixed to the identifying means by any conventional means, such as molding or otherwise enclosing the RFID tag 10 within the identifying means, or adhering the RFID tag directly to the identifying means. Predetermined passenger-specific information, such as name, address, telephone number, frequent-flyer account information, and emergency contacts may be "coded" into RFID tag 10 by communicating the information from a scanner to the RFID tag in the manner previously described.

After coding of RFID tag 10 is complete, the identifying means is then provided to the passenger prior to air travel. The identifying means is preferably carried on the passenger's person, such as in a purse or wallet. RFID tags 10 may also be supplied to the airport facility at step 104*b* for the uses described in detail below.

When the passenger arrives at the airport at step 106, a scanner scans the identifying means carried by the passenger and retrieves at least a portion of the passenger-specific information stored in the memory portion of the RFID tag. The scanning portion of the scanner sends the retrieved information to a computer portion (not shown), which creates a passenger record using the retrieved information. The passenger record may include a record number or other identification means to distinguish and locate the record. The scanner is able to retrieve stored information from multiple uniquely-coded RFID tags 10 in a group, thus eliminating the need for passengers to individually pass by or through the scanner. Thus, the scanner may be conveniently and unobtrusively placed at the entrance for the facility, such as within a door frame or mounted to a wall.

The passenger then proceeds to a check-in point at step 108. The check-in point may be automated or manned by airport personnel, and may take a variety of forms, such as a counter, desk, station, kiosk, stand, or table. RFID tag 10 may be utilized at check-in (or at other points in the system of FIG. 2) to facilitate preferential screening and access. For example, frequent flyer members may carry a membership card comprising an RFID tag 10. The membership card may be used by the frequent flyer member to gain access to members-only express check-in lines and members-only lounges.

At step 110 the passenger's identity is authenticated with respect to the RFID tag 10 affixed to the identifying means. Authentification may be made by any conventional means, such as visual inspection of the passenger, entry of a personal identification number ("PIN"), voice recognition, face recognition, retinal identification, fingerprint identification or other biometric. Once the passenger's identity has been confirmed, the check-in point will provide the passenger with information regarding the planned trip, such as travel itinerary and seat assignments. If any changes are required, the passenger enlists the aid of an airline representative or enters the changes directly by means of a self-serve terminal or kiosk. Once the information is correct, the passenger requests a boarding pass at step 112.

A boarding pass comprising an RFID tag 10 is then generated. In one embodiment the boarding pass is a conventional paper or plastic card comprising an affixed RFID tag 10. The boarding pass may first be scanned to retrieve the identifier number 18 of the RFID tag 10. The identifier number 18 is then recorded in the passenger record, "associating" the boarding pass to the passenger. The passenger-specific information relating to the boarding pass, such as the passenger's identity, itinerary and boarding pass number, may likewise be stored on the passenger record along with the identifier 18. Passenger-specific boarding pass information, including a passenger record number, may also be stored in the memory portion of the RFID tag 10 affixed to the boarding pass, if desired. The boarding pass is then printed with passenger-specific information pertaining to the itinerary or is otherwise issued in any conventional manner and provided to the passenger.

At step 114 the passenger proceeds to a baggage check-in point, which may be automated or manned by airport personnel. The baggage check-in point is expecting the passenger, having been supplied with the information gathered at steps 106 and 108 via the computer portion of the scanner. If the baggage check-in point is automated, a display or computerized voice messaging system may be utilized to offer the customer a personalized greeting. If the baggage check-in point is manned by airport personnel, the information may be shown on a display viewable by the airport personnel so that they may identify the passenger and offer them a personalized greeting. An image of the passenger may optionally be displayed to aid personnel in identification.

One or more baggage tags having RFID tags 10 may be affixed to the baggage at step 116. The RFID tags 10 are scanned to retrieve the identifier 18 information, which is associated with the passenger record by scanning the RFID tag 10 affixed to the baggage to retrieve the identifier number 18, then storing the identifier number in the passenger record associated with the RFID tag. Information such as a description of the bag may also be added to the record. The passenger's identity, itinerary, passenger record number and any other pertinent information may optionally be stored in the memory portion of the RFID tags 10 at step 118.

At step 120 the passenger's baggage is electronically screened or otherwise inspected in any conventional manner, such as a search of the baggage contents, to ensure that the contents of the baggage conform to predetermined security criteria. Data pertaining to the inspection, such as a text summary and/or an image of the contents of the baggage, may be stored in the computer portion. The inspection data may be associated with the passenger record by scanning the RFID tag 10 affixed to the baggage to retrieve the identifier number 18, then storing the inspection data in the passenger record associated with the RFID tag. Alternatively, the inspection data may be stored in a separate electronic file, with the name and location (i.e., a "link) for the separate file being placed in the passenger record. After the baggage has completed inspection, it may be collected from the passenger for placement on the departure aircraft listed in the passenger's itinerary.

After checking the baggage, the passenger proceeds to a security checkpoint at step 122 prior to entering the airport gate areas. As part of the security procedure, the passenger's carry-on items, such as suitcases, briefcases and personal computers, may also have RFID tags 10 affixed, and may be electronically scanned or otherwise inspected in any conventional manner, such as a search of the baggage contents. The inspection may take place at a security checkpoint, as at step 123. Data relating to the inspection of the carry-on may be stored and associated with the passenger record in the same manner as previously described at step 120. The passenger's stop at the security checkpoint may also be used to record the current location of the passenger in the passenger record. A scanner located at the security checkpoint may scan any of the RFID tags carried by the passenger, locate the associated passenger record, and record the date, time and location where the RFID tag was scanned.

Once clear of the security checkpoint, the passenger may proceed to the gate area. RFID tags 10 carried by the passenger, such as the identification means and boarding pass, may be used to guide the passenger to the appropriate gate and provide the passenger with passenger-specific itinerary updates such as gate and departure time changes at step 124. Step 124 may be accomplished by means of scanners located at convenient guidance points, such as a counter, desk, station, kiosk, stand, table and passenger thoroughfares. The scanners may read the passenger information stored on the RFID tag 10 and provide the desired information on a display adapted to attract the passenger's attention. Such passenger-specific guidance is particularly useful to passengers unfamiliar with the airport, children traveling alone, and passengers needing assistance due to time constraints and distances between gates. The passenger-specific guidance may be automated with electronic displays or printed information, or manned by airport personnel. The information display may optionally include marketing and advertising displays in a manner similar to that commonly seen on internet web pages and may even be programmed to be interactive with the passenger. For example, gender and age specific advertising can be created with computer generated animated characters which can engage the person walking along side of the visual wall display, engaging them in conversation and showing them features of a product. The system would track the person position in relation to the advertising wall and the animated character would be automatically positioned along side the person walking next to the wall. The advertising wall is an acrylic or glass or rear projected screen where the computers project a computer generated likeness of a person or animal which would interact with the passers by. This form of advertising can be used to promote a cartoon or movie by enabling the advertiser to talk to a captive audience. At the airport the character can read a book to the children waiting for a fight for example. Based on observable interactive behaviors the animated characters can ask simple yes/no questions from the person in response to their willingness to interact with the advertising display. The delivery mechanism for distributing the audio/video advertising would be the World Wide Web. An advertiser can upload new commercials and geographically distribute them to the various geographically dispersed advertising display points, such as the "VideoGateway.TV" internet-based video delivery service. The advertiser, using involuntary audience participation, can use the information to obtain statistics as to the effectiveness of a marketing campaign and viewership participation.

The RFID tag 10 facilitates increased security measures within the airport with little or no additional burden or restriction of passenger movement. For example, security personnel may carry hand-held scanners to perform random passenger checks at step 125 by simply coming into proximity to the RFID tags carried by passengers. The hand-held scanner may be used to identify passengers and look up associated passenger records, minimizing the need to stop passengers to ask them security-related questions, which can disrupt the flow of passenger traffic. Similarly, at step 125 any of the scanners located about the airport may be used to cross-check data on the RFID tags 10 carried by the passenger with the passenger record to ensure that no information is missing, and that no conflicts exist between the passenger record and the RFID tags. If any missing information or conflicts are found, such as mismatches between the boarding pass and the passenger record, the passenger may be paged or stopped during the boarding process to resolve the problem.

Upon boarding the aircraft at step 126, one or more scanners in the boarding area may be used to automatically read the passengers' boarding passes in groups, facilitating faster boarding. The scanner may also cross-check the passengers' boarding passes, baggage and carry-on bags with their identifying means, and issue a security alert if any discrepancies or mismatches are found. This step is also useful for preventing passengers from mistakenly boarding the wrong aircraft, as can happen during the confusion and activity often present during the boarding process.

Baggage checked at step 120 may be tracked throughout the passenger's airline travel itinerary by appropriate placement of scanners. For example, scanners may be placed at baggage collection points, the aircraft baggage compartment, baggage sorting areas, and baggage claim areas. The RFID tag 10 associated with the baggage may be scanned at various points of the itinerary, and the passenger record may be updated, providing airline and security personnel with current information regarding the location of the baggage. As a further example, the baggage location information can be used to provide passengers with information regarding the location of their baggage, such as via a text message sent to one or more displays located about the airport or sent to the passenger's cell phone, notifying them of which carousel they need to visit to pickup their checked baggage.

The RFID tags 10 affixed to the passengers' identifying means, carry-on bags, and boarding passes may be read by scanners placed at strategic traffic points in the airport facility, to track and record passengers' whereabouts within the airport. When a passenger moves in proximity to a scanner, the scanner retrieves the identifier 18 of an RFID tag 10, locates the associated passenger record, and adds information indicating the date, time and location where the RFID tag was scanned. If a passenger is scheduled to board a flight but is not in the gate area, the passenger's general location can be quickly ascertained by reviewing the passenger record. Similarly, if the passenger record indicates that the passenger has left the facility, security personnel may elect to remove the passenger's checked baggage from the aircraft as a security precaution. The baggage may be quickly located in the baggage compartment by using a hand-held scanner to locate the RFID tag attached to the baggage. Further examples include tracking passengers' whereabouts to provide information regarding the passenger's position to loved ones and business associates when a passenger arrives at their destination. Thus, a parent can check on the arrival of a child at the airport (given appropriate access to the data), and a rent-a-car company can send a driver with a prepaid rental car to greet the arriving passenger.

In a first alternate embodiment of the present invention, RFID tags 10 may be used to identify and track the movement and location of personnel other than passengers. As an example, "personnel" may include any person who normally moves about the airport facility, such as pilots, airline employees, airport employees and vendors. An RFID tag 10 is coded with information specific to the personnel, such as name, employer, employee identification number, job junction, and authorized access areas. The RFID tag 10 is then affixed to a means for identifying the member. Example means include, but are not limited to, identification badges, identification cards and clothing such as personalized work shirts. An electronic record is generated and associated with the identifier 18 of the member's identification means. When the member moves near a scanner, the scanner may electrically scan the RFID tag 10 carried by the member, retrieve the identifier 18, and place an entry in the associated electronic record indicating the date, time and location where the RFID tag was scanned. Thus, the general whereabouts of the employee at any given time may be ascertained by reviewing the electronic record. RFID tags 10 may also be combined with magnetic or optical identification cards or badges, permitting security personnel to compare the "swipes" of an optical or magnetic card or badge with records generated by RFID scanners, allowing security personnel to detect discrepancies or identify suspicious behavior.

In a second alternate embodiment of the present invention, scanners may be programmed to monitor for the presence of particular persons and/or articles. For example, scanners positioned about the airport may compare the identifier numbers 18 of scanned RFID tags 10 to a "wanted" list of identifiers associated with fugitives, known terrorists and wanted suspects. Likewise, the identifier numbers 18 associated with lost or stolen articles having an RFID tag 10 may be placed on a "lost" list to be checked by scanners. If an identifier number 18 appearing on a "wanted" or "lost" list is detected by one or more scanners, security forces may accordingly be notified of the person or article and the location where they may be found.

In a third alternate embodiment of the present invention, RFID tags 10 may be attached in any conventional manner to children traveling as passengers. In the event that a child becomes lost, scanners located about the airport could be utilized to detect an RFID identifier 18 of an RFID tag 10 associated with the child and report the location of the child to security forces.

In a fourth alternate embodiment of the present invention, scanners may be coupled with electronic displays installed about the airport. The scanners and displays may serve multiple purposes, such as security, guidance, and passenger-specific advertising. With regard to advertising, when a passenger approaches an electronic display, an associated scanner may detect and read an RFID tag 10 carried by the passenger, such as an RFID tag affixed to a boarding pass or the passenger's carry-on items. The computer portion of the scanner may obtain information about the passenger from the previously-created passenger record and then present advertising targeted to the passenger. As an example of targeted advertising, the system may detect that the passenger is a female and present advertising for perfume. Likewise, if the passenger is a male, the system may present advertising for cologne. Similarly, the passenger's itinerary may be obtained from the passenger record and advertising relating to the passenger's destination may be presented. The leasing of such advertising space could be used to offset the expense of installing and maintaining an RFID system. Furthermore, demographic information collected by scanners may be licensed to third party users for census, marketing and statistical purposes to both generate income and improve customer service.

If an article having an RFID tag 10 is lost or stolen, the identifier number 18 or other related information may be added to a list maintained in a computer system of the present invention. The system may be configured to check scanned identifier numbers 18 to see if the number appears on such a list. In the event that a scanned RFID tag 10 appears on the list, any desired predetermined response may be initiated, such as writing to the RFID tag 10 to disable it and prevent an unauthorized person from utilizing it, generating an alarm signal to security personnel along with information regarding the location where the RFID tag was scanned, and automatically locking exit doors to prevent escape.

As can be seen, the present invention provides a more efficient and accurate means for tracking and handling people and articles in an airport facility. Even if a large number of passengers and baggage within an airport utilize the present invention, the ability of the system to read RFID tags 10 quickly—including reading groups of RFID tags—permits the present invention to increase the throughput of passengers and baggage while providing an increased level of security.

Although the present invention has been described with reference to passengers and baggage at an airport, one skilled in the art will realize that many embodiments fall within the scope of the present invention. In summary, the present invention may be used to advantage in any means of public transport, and in any setting where security screening of persons and/or articles is required. For example, the present invention can be used for marketing and advertising at any public forum, such as trade shows and shopping malls.

While this invention has been shown and described with respect to several detailed embodiments thereof, it will be understood by those skilled in the art that various changes in form and detail thereof may be made without departing from the scope of the claims of the invention. One skilled in the art will recognize that many of the separately-described functions of the various embodiments of the present invention may be combined, rearranged or eliminated to accomplish the desired result without affecting the scope of the invention. The embodiments disclosed herein are for illustrative purposes only and are not intended to be limiting with regard to the arrangement or combination of the components of the present invention.

What is claimed is:

1. A method for tracking personnel and articles, comprising the steps of:

a) coding an RFID tag with a unique identifier, the identifier being stored in a memory portion of the RFID tag;

b) affixing the RFID tag to a means for identifying one of a select member of the personnel and a select article;

c) providing the identifying means to the select member or affixing the identifying means to the select article;

d) associating the identifier of the RFID tag with the select member or select article, and associating the identifier with a list of wanted personnel and articles;

e) electrically scanning the RFID tag when the select member or article is proximate a scanner to retrieve the identifier number of the RFID tag;

f) comparing the identifier number of the scanned RFID tag with the list;

g) notifying security personnel of the location of the select member or article if the identifier of the scanned RFID tag appears on the list; and h) wherein the select member or article is located.

2. A method for tracking and processing passengers and their transported articles, comprising the steps of:

a) coding each of a plurality of RFID tags with a unique identifier, the identifier being stored in a memory portion of each RFID tag;

b) coding a first RFID tag with information relating to a select passenger, the information being stored in the memory portion of the first RFID tag;

c) affixing the first RFID tag to a means for identifying the select passenger;

d) providing the identifying means to the select passenger;

e) electrically scanning the first RFID tag to retrieve passenger-specific information when the identifying means is transported to an airport by the select passenger;

f) generating a passenger record for the select passenger using the passenger-specific information;

g) authenticating the identity of the select passenger with respect to the identifying means;

h) associating a second RFID tag with the passenger record, the second RFID tag being affixed to a boarding pass for an airline flight;

i) storing passenger-specific flight data in at least one of the passenger record and the second RFID tag;

j) issuing the boarding pass to the select passenger;

k) associating a third RFID tag with the passenger record, the third RFID tag being affixed to a first baggage label;

l) affixing the first baggage label to the passenger's baggage, wherein at least one of the passenger-identifying means, boarding pass, and first baggage label are used in cooperation with the passenger record and at least one electrical scanner to retrieve information relating to the passenger and/or baggage;

m) inspecting the baggage for any contents that do not meet predetermined security regulations;

n) storing data relating to the inspection of the baggage comprising at least one of textual data and imaging information corresponding to the inspection of the baggage and its contents; and o) associating the baggage inspection data to the passenger record.

3. A method for tracking and processing passengers and their transported articles, comprising the steps of:

a) coding each of a plurality of RFID tags with a unique identifier, the identifier being stored in a memory portion of each RFID tag;

b) coding a first RFID tag with information relating to a select passenger, the information being stored in the memory portion of the first RFID tag;

c) affixing the first RFID tag to a means for identifying the select passenger;

d) providing the identifying means to the select passenger;

e) electrically scanning the first RFID tag to retrieve passenger-specific information when the identifying means is transported to an airport by the select passenger;

f) generating a passenger record for the select passenger using the passenger-specific information;

g) authenticating the identity of the select passenger with respect to the identifying means;

h) associating a second RFID tag with the passenger record, the second RFID tag being affixed to a boarding pass for an airline flight;

i) storing passenger-specific flight data in at least one of the passenger record and the second RFID tag;

j) issuing the boarding pass to the select passenger;

k) associating a third RFID tag with the passenger record, the third RFID tag being affixed to a first baggage label; and l) affixing the first baggage label to the passenger's baggage, wherein at least one of the passenger-identifying means, boarding pass, and first baggage label are used in cooperation with the passenger record and at least one electrical scanner to retrieve information relating to the passenger and/or baggage, and wherein the display electrically scans at least one RFID tag carried by a select passenger, retrieves at least a portion of at least one of the passenger-specific information, flight data and passenger record, and displays advertising directed to the select passenger.

4. A method for tracking and processing passengers and their transported articles, comprising the steps of:

a) coding each of a plurality of RFID tags with a unique identifier, the identifier being stored in a memory portion of each RFID tag;

b) coding a first RFID tag with information relating to a select passenger, the information being stored in the memory portion of the first RFID tag;

c) affixing the first RFID tag to a means for identifying the select passenger;

d) providing the identifying means to the select passenger;

e) electrically scanning the first RFID tag to retrieve passenger-specific information when the identifying means is transported to an airport by the select passenger;

f) generating a passenger record for the select passenger using the passenger-specific information;

g) authenticating the identity of the select passenger with respect to the identifying means;

h) associating a second RFID tag with the passenger record, the second RFID tag being affixed to a boarding pass for an airline flight;

i) storing passenger-specific flight data in at least one of the passenger record and the second RFID tag;

j) issuing the boarding pass to the select passenger;

k) associating a third RFID tag with the passenger record, the third RFID tag being affixed to a first baggage label; and l) affixing the first baggage label to the passenger's baggage, wherein at least one of the passenger-identifying means, boarding pass, and first baggage label are used in cooperation with the passenger record and at least one electrical scanner to retrieve information relating to the passenger and/or baggage, and wherein the second RFID tag is electrically scanned to permit or deny the select passenger access to a select aircraft.

* * * * *